US009022171B2

(12) United States Patent
Caimi

(10) Patent No.: US 9,022,171 B2
(45) Date of Patent: May 5, 2015

(54) ADJUSTABLE SOUND-ABSORBING PANEL AND ASSEMBLY OF ADJUSTABLE SOUND-ABSORBING PANELS

(71) Applicant: ELEDA S.r.l., Milan (IT)

(72) Inventor: Renato Caimi, Milan (IT)

(73) Assignee: ELEDA S.r.l., Milan (IT)

( * ) Notice: Subject to any disclaimer, the term of this patent is extended or adjusted under 35 U.S.C. 154(b) by 0 days.

(21) Appl. No.: 14/084,688

(22) Filed: Nov. 20, 2013

(65) Prior Publication Data

US 2014/0299407 A1 Oct. 9, 2014

(30) Foreign Application Priority Data

Apr. 3, 2013 (IT) ..... MI20130122 U

(51) Int. Cl.

| | |
|---|---|
| ***E04B 1/84*** | (2006.01) |
| ***E04B 1/82*** | (2006.01) |
| ***E04B 9/00*** | (2006.01) |
| ***E04B 9/04*** | (2006.01) |
| ***E04B 9/34*** | (2006.01) |

(52) U.S. Cl.

CPC ..... *E04B 1/8209* (2013.01); *E04B 9/001* (2013.01); *E04B 9/045* (2013.01); *E04B 9/34* (2013.01); *E04B 2001/8263* (2013.01); *E04B 2001/8461* (2013.01)

(58) Field of Classification Search

CPC ... E04B 2001/8263; E04B 1/99; E04B 1/994; E04B 9/001; E04B 9/045; E04B 9/34; E04B 1/8209

USPC ..... 181/30, 191, 284, 287, 290

See application file for complete search history.

(56) References Cited

U.S. PATENT DOCUMENTS

| | | | | |
|---|---|---|---|---|
| 1,617,384 | A * | 2/1927 | Fisk | 454/225 |
| RE30,300 | E * | 6/1980 | Ploeger | 84/400 |
| 4,362,222 | A * | 12/1982 | Hellstrom | 181/30 |
| 4,516,656 | A * | 5/1985 | Fleshler | 181/175 |
| 5,992,561 | A * | 11/1999 | Holben et al. | 181/295 |
| 6,490,828 | B1 * | 12/2002 | Volesky et al. | 52/36.1 |
| 8,070,114 | B2 * | 12/2011 | Chen | 248/121 |
| 8,091,605 | B1 * | 1/2012 | Melhart | 160/135 |
| 2007/0040084 | A1 * | 2/2007 | Sturman et al. | 248/280.11 |
| 2008/0190690 | A1 * | 8/2008 | Waters | 181/287 |
| 2014/0116632 | A1 * | 5/2014 | Domash | 160/369 |

* cited by examiner

*Primary Examiner* — Jeremy Luks

(74) *Attorney, Agent, or Firm* — Patti & Malvone Law Group, LLC

(57) ABSTRACT

A directable sound-absorbing panel comprising a sound-absorbing panel, a fixing member which can be fixed to said sound-absorbing panel, an arm and an articulated joint between said fixing member and said arm, is described. An assembly of directable sound-absorbing panels is also described, said assembly comprising a plurality of sound-absorbing panels, a corresponding plurality of fixing members, a corresponding plurality of arms, a corresponding plurality of articulated joints between each arm and each fixing member, and a fixing bar to which at least a part of said plurality of arms is fixed.

20 Claims, 9 Drawing Sheets

ADJUSTABLE SOUND-ABSORBING PANEL AND ASSEMBLY OF ADJUSTABLE SOUND-ABSORBING PANELS

CROSS REFERENCE

This application claims the benefit of Italian Appl. No. MI2013U000122, filed Apr. 3, 2013, the respective contents of which are hereby incorporated by reference in their entirety.

FIELD OF APPLICATION

The present invention relates to a directable sound-absorbing panel and an assembly of directable sound-absorbing panels.

BACKGROUND

It is known that, when a sound wave emitted in a closed environment encounters a surface, a part of its energy passes through the surface, a part is absorbed by the impact with the surface and a part is reflected into the environment.

If an environment has a large reflective surface area, the acoustics in the environment may be greatly affected since the sound waves produced inside it are amplified with an effect similar to that of an echo.

In order to improve the acoustics of an environment without structural modifications, it is known to provide in the environment one or more sound-absorbing panels for absorbing most of the energy.

When correcting the acoustics, the internal surfaces of the environments are lined with sound-absorbing materials; these materials must have suitable characteristics not only from an acoustic but also from an aesthetic point of view since they must blend in with the architecture and the furnishings.

Sound-absorbing materials have the property that they absorb at least part of the acoustic energy and reduce the amount of energy which is reflected.

The known sound-absorbing panels, which are to be mounted for example on a wall, have a structure which is composed of a layer of foam (for example foam rubber), lined with a sheet, and kept rigid by a perimetral frame made of metal (for example aluminum), plastic or wood. The sheet is typically folded around the perimetral frame so as hide, at least on a visible side, stitches or other joints. However, when a sound-absorbing panel must have two visible sides, it is more difficult to conceal a joint in the sheet in a zone where two end portions of the sheet overlap.

In other known panels, the padding layer is combined with a rigid surface (for example made of metal, plastic or wood) which increases its rigidity and/or increases its acoustic performance. The rigid surface may be positioned on one side of the padding or inside the padding itself, creating a sandwich structure.

A first disadvantage of the sound-absorbing panels designed in accordance with the prior art consists in the presence of the frame or the support surface. They may in fact have a considerable weight and hence be difficult to handle, mount and support; moreover often the frame or the support surface are the most costly item of the panel.

Another disadvantage, as already mentioned, is that the sound-absorbing panels must have not only good sound-absorbing properties but also suitable aesthetic characteristics since they must blend in with the architecture and the furnishings. The frame and the joints between two end portions of a sheet used to cover the panel are undoubtedly negative elements which may create a lack of harmony with the surrounding environment.

Moreover, the frame (especially if made of metal) of a sound-absorbing panel does not act as a sound-absorbing material and often reduces the surface area of the sound-absorbing padding which can be effectively reached by the waves.

Moreover, sound-absorbing panels, the direction of which can be freely and easily adjusted, namely by means of simple operations can be arranged in different directions with respect to a wall or a ceiling of the environment where they are mounted, are not known. This constitutes a fairly major limitation because a better result in terms of sound-absorbing performance may be achieved by arranging the surface of the sound-absorbing panel as far as possible perpendicularly with respect to a sound source.

The technical problem is that of providing a sound-absorbing panel which is relatively simple to construct and install and which solves at least one of the abovementioned problems.

SUMMARY

The Applicant has realized that the problem may be solved with a sound-absorbing panel, preferably with a main surface which is substantially flat and which has, fixed thereto, a fixing member, an arm and an articulated joint between them so that the direction of the panel may be adjusted. Preferably the panel comprises a padding layer with a variable density which is higher in an outer layer and lower in the central layer. The higher density in an outer layer increases substantially the rigidity of the panel without negatively influencing the sound-absorbing performance.

The increased rigidity, in turn, results in the possibility of using the panel without a frame and of fixing screws (typically common wood screws) or other fixing elements directly into the panel itself. Moreover, owing to its greater rigidity, a substantially flat panel able to maintain substantially its substantially planar form is obtained.

According to a first aspect, the invention provides a directable sound-absorbing panel comprising a sound-absorbing panel, a fixing member which can be fixed to said sound-absorbing panel, an arm and an articulated joint between said fixing member and said arm.

The fixing member may comprise a plate having one side cooperating with a surface of the sound-absorbing panel.

The articulated joint may be a ball joint. Said articulated joint may comprise a base integral with said fixing member, a spherical head integral with the arm and a gripping clamp for gripping the ball joint on the base.

Alternatively, for example, the articulated joint may comprise a flexible tube designed to maintain a deformation imparted to it.

The arm may comprise a tubular section.

The arm may have an L shape with a flattened section.

Advantageously, the fixing member is fixed to said sound-absorbing panel by means of screws which are directly screwed into said sound-absorbing panel.

Preferably, the panel comprises a padding layer with heat-bonded synthetic fibers, wherein said padding layer has a first thickness and wherein, in at least one portion of said panel, said panel has a variable density, in a direction substantially transverse to the outer surface, said density being higher in an outer later thereof and being lower in its inner layer.

Preferably, the sound-absorbing panel also comprises a first layer of fabric facing a first side of said padding layer and a second layer of fabric facing a second side of said padding layer.

The padding layer may be shaped so as to have an edge with a second thickness smaller than the first thickness on at least a part of a perimeter of the panel.

The panel may have a shape, in plan view, of an irregular quadrilateral with a single obtuse angle. Alternatively, the panel may have other shapes, for example a triangular, square, rectangular, round, oval, elliptical or other shape.

Preferably, the heat-bonded synthetic fibers comprise polyester fibers.

According to another aspect, the invention relates to an assembly of directable sound-absorbing panels. The assembly comprises a plurality of sound-absorbing panels, a corresponding plurality of fixing members, a corresponding plurality of arms, a corresponding plurality of articulated joints between each arm and each fixing member, and a fixing bar to which at least a part of said plurality of arms is fixed.

Each of the fixing members preferably comprises a plate with a flat side cooperating with a surface of a sound-absorbing panel.

In one embodiment at least one of the articulated joints is a ball joint.

The ball joint typically comprises a base integral with a respective fixing member, a spherical head integral with the arm and a gripping clamp for gripping said ball joint on said base.

In other embodiments, at least one of the articulated joints comprises a flexible tube designed to maintain a deformation imparted to it.

Each arm may comprise a tubular section and is rotatable with respect to said bar.

Preferably, each panel comprises a padding layer with heat-bonded synthetic fibers, wherein said padding layer has a first thickness and wherein, in at least one portion of said panel, said panel has a variable density, in a direction substantially transverse to the outer surface, said density being higher in an outer layer thereof and being lower in its inner layer.

In some embodiments, each panel has the shape, in plan view, of an irregular quadrilateral with a single obtuse angle. Alternatively, the panels may have other shapes, for example a triangular, square, rectangular, round, oval, elliptical or other shape.

Preferably the heat-bonded synthetic fibers comprise polyester fibers.

The invention will emerge more clearly from the following detailed description, provided purely by way of a non-limiting example, to be read with reference to the accompanying drawings.

DETAILED DESCRIPTION

Figure 1:
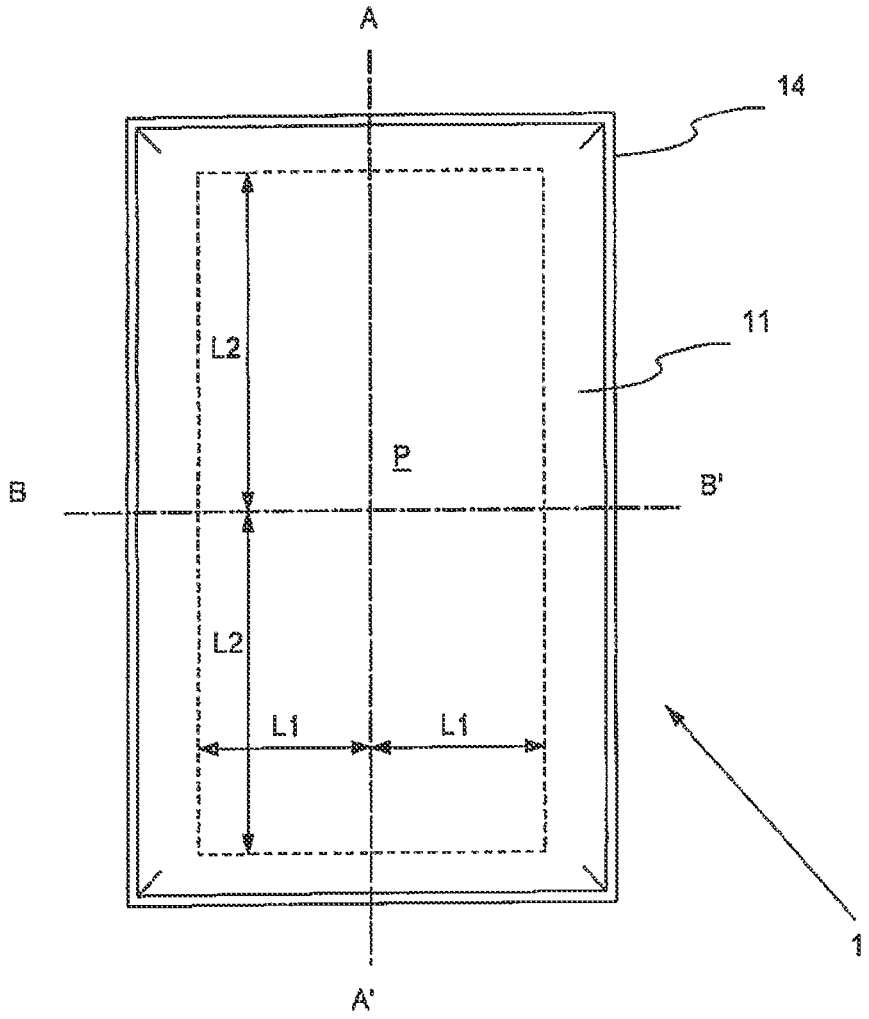
FIG. 1 is a schematic front plan view of a sound-absorbing panel suitable for realizing the present invention.
Figure 2:
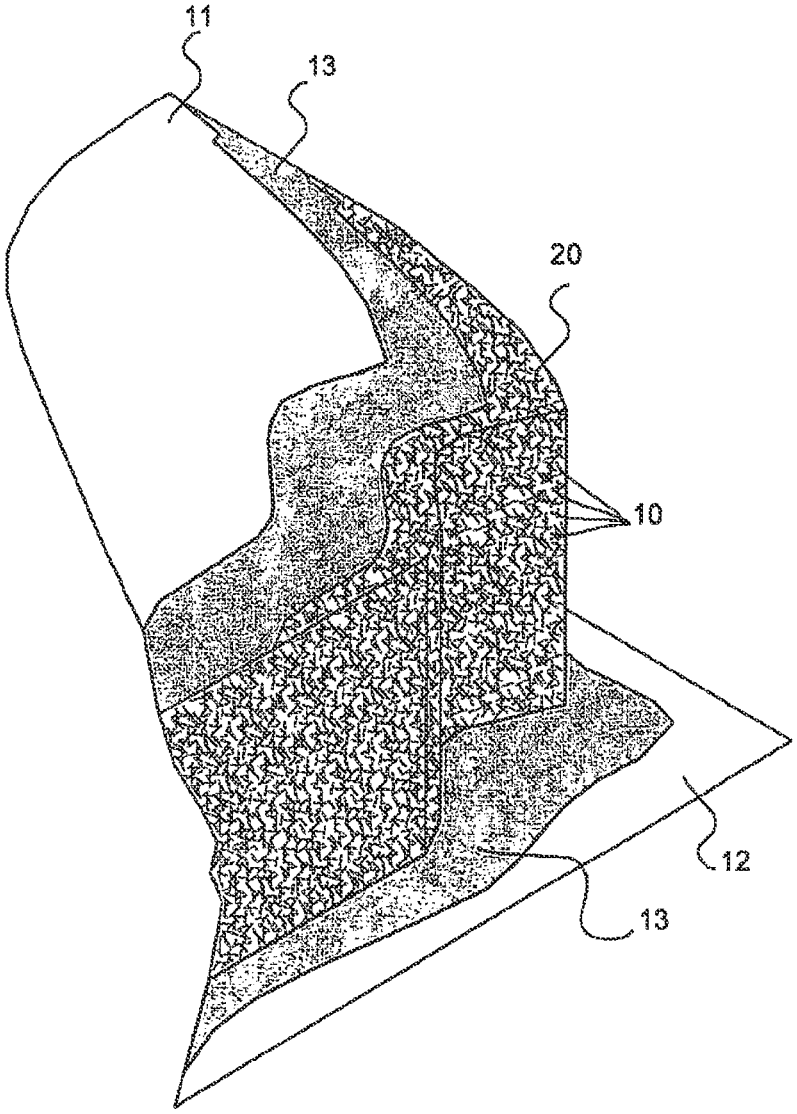
FIG. 2 shows the various layers of the panel according to FIG. 1.
Figure 3:
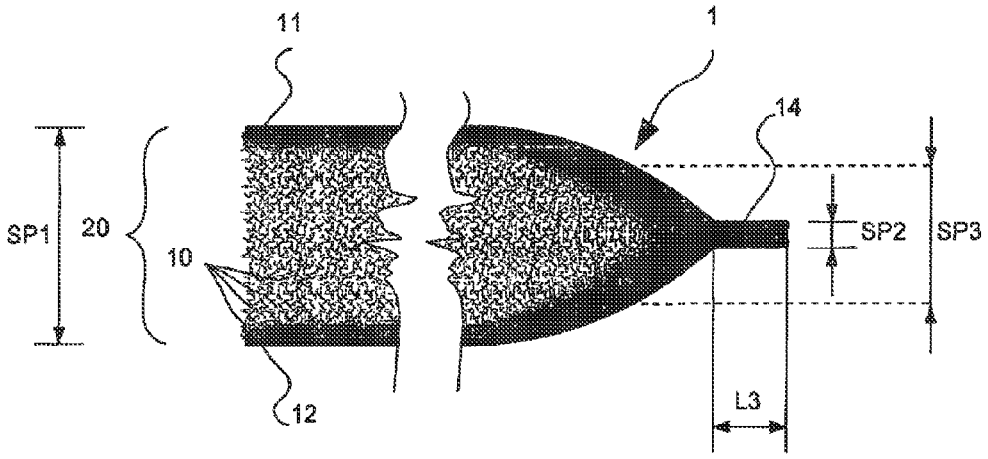
FIG. 3 is a schematic cross-sectional view of a part of the panel according to FIG. 1.

With reference to FIGS. 1, 2 and 3, these show a sound-absorbing panel 1 comprising a suitably shaped padding layer 20 comprising heat-bonded synthetic fibers 10, a first and a second layer of fabric facing opposite sides of the padding layer 20. The padding layer 20 is shaped so that it has an edge 14 with a thickness smaller than the thickness of the padding layer at a central location of the panel 1.

The panel may have a rectangular shape (as in FIG. 1) or any other shape such as a square, rhombus-like, trapezoidal, irregular quadrilateral, circular, oval, elliptical, triangular or other shape.

In one embodiment, the heat-bonded synthetic fibers 10 comprise polyester fibers.

The fibers 10, before processing, may have a density ranging from about 10 kg/m$^3$ to about 100 kg/m$^3$, for example between 30 kg/m$^3$ and 60 kg/m$^3$.

In a preferred embodiment, the fibers 10, before processing, have a density substantially equal to 44+/−5 kg/m$^3$.

The average density after processing is about 72+/−10 kg/m$^3$.

Preferably, the fibers 10 have a diameter of between about 20 μm (micron) and about 50 μm (micron), preferably a diameter of between about 30 μm and about 35 μm.

The fibers 10 may be used in a temperature range of between about −40° C. and about 80° C.

Preferably, the fibers are non-toxic and non-irritants. Furthermore they are completely recyclable.

The sound-absorbing panel 1 preferably comprises a first layer of fabric 11 facing a first side of the padding layer 20. The sound-absorbing panel 1 also comprises, preferably, a second layer of fabric 12 facing a second opposite side of the padding layer 20. See FIG. 2 and FIG. 3.

Preferably, the layers of fabric 11, 12 are also made of polyester.

For example, the fabric is made by intertwining an elastic textured yarn with a yarn count of 750 dtex per warp and weft. The structure may be formed by 1600 yarns and 1500 wefts per meter using a crepe weave. The weight per square meter may be about 300 g. In one embodiment, the fabric is of the flame-retardant Trevira CS type.

The panel 1 may comprise preferably an adhesive layer 13 arranged between the padding layer 20 and each of the layers of fabric 11 and 12.

In particular, the adhesive layer 13 may advantageously comprise a layer of glue, preferably applied by means of spreading.

The panel 1, at a central location P thereof (FIG. 1), has a first thickness SP1, preferably of between about 2 cm and about 7 cm. In one embodiment, the first thickness ranges between about 3.4 cm and 3.7 cm.

For the purposes of the present description and the accompanying claims, the term "central location P" is understood as meaning a location inside a central area of the panel. In turn, the term "central area" is understood as meaning an area sufficiently distant from the perimeter of the panel and from the transition contour. For example, in the case of a panel of rectangular shape with a first axis A-A' parallel to the long side and a second axis B-B' parallel to the short side, the central area is a substantially rectangular area which is symmetrical with respect to the first axis (A-A') and the second axis (B-B'). The central area may have a width equal to 2×L1, where L1 is about 30% of the width of the panel, and a length equal to 2×L2, where L2 is about 30-40% of the height of the panel. In FIG. 1 a central area for the panel 1 is indicated for example by means of a broken line. For a panel with a square shape, the central area may have a square area centered on the center of the panel having a side with a length equal to about 50% of the side of the panel. In the case of a circular shaped panel, the central area may have a circular area centered on the center of the panel and having a diameter equal to about 50% of the panel diameter. In the central area there may be fastening depressions, but these small-thickness localized depressions need not be considered for the purposes of an assessment of the thickness of the panel in the central area.

With particular reference to FIG. 3, advantageously, according to embodiments of the invention, the panel 1 is shaped so as to have an edge 14 with a second thickness SP2 smaller than the first thickness SP1. The edge has a width L3 (FIG. 3) which may be for example about 0.5-2.0 cm.

According to embodiments of the invention, the second thickness SP2 at the edge 14 is between about 5% and about 20% of the first thickness SP1.

According to embodiments of the invention, the edge 14 is formed on at least a part of the perimeter of the panel 1.

Preferably, the edge 14 is formed along the entire perimeter of the panel 1.

According to embodiments of the invention, the panel 1 has a transition thickness SP3 which is variable depending on the distance between the edge 14 and the central location P.

In particular, the transition thickness SP3 increases from the value of the second thickness SP2 to the value of the first thickness SP1 with a substantially logarithmic progression upon an increase in the distance from the edge 14.

The panel 1 has different density values starting from the central location P and progressing as far as the edge 14. The greatest density is illustrated schematically in FIG. 3 by means of darker areas where the fibers are closer and more compact.

Moreover, preferably, the padding layer 20, in at least one portion of the panel (for example the central area P) has a variable density, higher in an outer layer thereof and lower in its inner layer. The structure is preferably symmetrical.

Preferably, the padding layer 20 at the central location P has a density ranging between about 40 kg/m$^3$ and 90 kg/m$^3$, preferably about 74+/−10 kg/m$^3$.

Differently, the padding layer 20 along the edge 14 has a density ranging between about 350 kg/m$^3$ and 900 kg/m$^3$, preferably about 530 kg/m$^3$+/−20%.

Advantageously, according to the invention, the structure created does not require any support frame; in fact the edge 14 acts as a frame. Reinforcements or layers other than the padding layer are not arranged between the two outer layers.

Moreover, the panel does not require any joining together of end portions of a sheet since no covering sheet is used; the cover, in fact, in one embodiment, is composed of the layers of fabric 11 and 12 which form a single body with the padding layer 20. The aesthetic features are, therefore, particularly attractive and may be blended in (as regards both color and shape) with the features of the surrounding environment. In another embodiment, by way of alternative or in addition to the two layers of fabric 11, 12, a removable cover (not shown in the drawings) may be provided for covering the panel and adapting it to various requirements. For example, a personalized cover bearing the logo of a company, images or decorations may be provided. Moreover, advantageously, the edge 14 of the sound-absorbing panel of the invention also acts, at least partly, as a sound-absorbing material and prevents sound waves from being reflected. In fact, the edge is made of the same material as the central part, albeit with a different density and different mechanical properties.

Owing to the low weight of the panel 1 all the support means required for hanging or joining the panel may be easily provided.

Preferably the padding layer 20 and the layers of fabric 11, 12 are made of fireproof material.

Preferably the padding layer 20 and the layers of fabric 11, 12 are treated with anti-bacterial material.

To conclude, the panel described above achieves a plurality of advantages, among which the following: it does not require any support frame since the edge acts as a frame; it does not require joining together of the end portions of the sheet; it allows other members or components to be fixed to it by means of ordinary wood screws or the like; the aesthetic features of the panel are particularly pleasing and may be blended in with the features of the surrounding environment; the edge also acts, at least partly, as a sound-proofing material and prevents the sound waves from being reflected; it may be easily hung from a wall or a ceiling or joined to a support post since it has a very low weight compared to the panels of the prior art; owing to the low weight of the panel all the support means required to hang or join the panel may be easily provided; it is completely recyclable since it is made entirely of polyester.

Figure 4A:
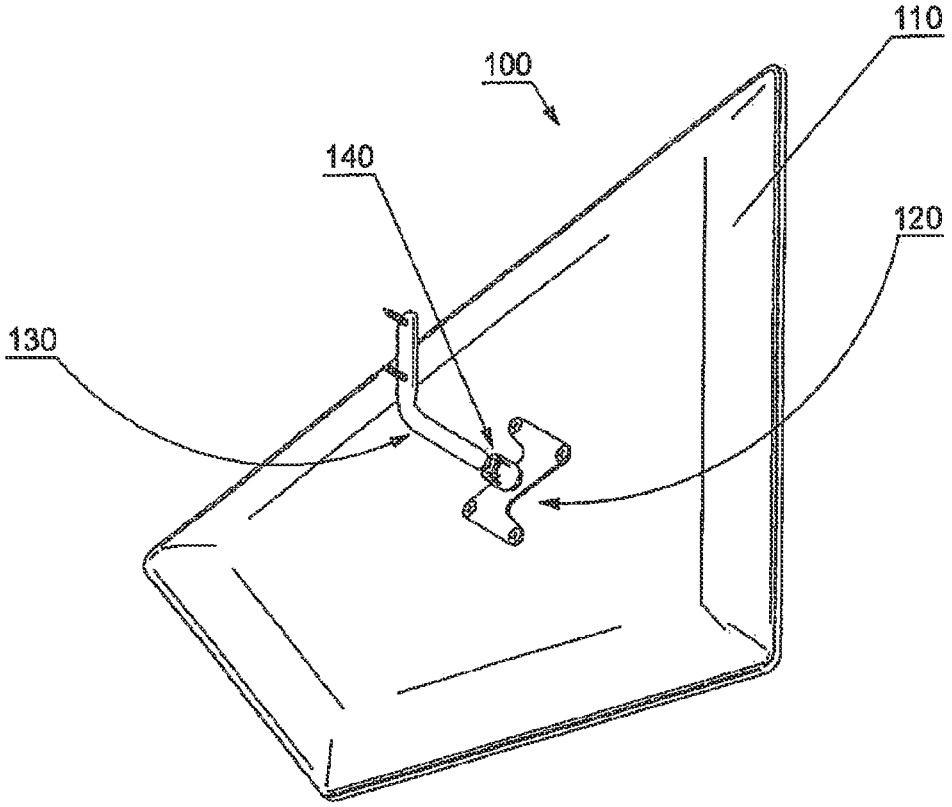
FIG. 4*a* is a schematic view of a sound-absorbing panel, a fixing member, an arm and an articulated joint between them according to an embodiment of the invention.
Figure 4B:
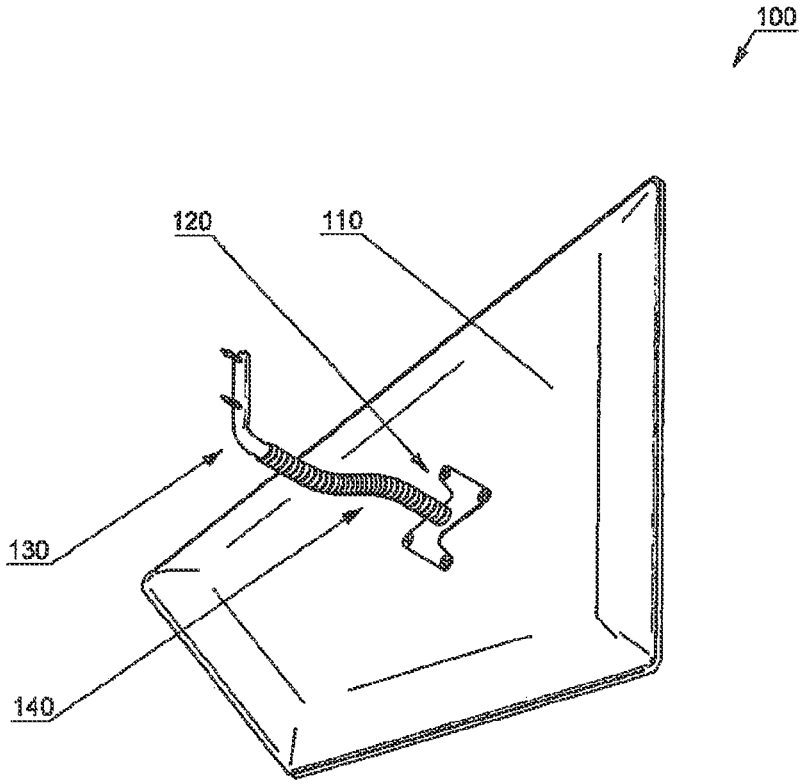
FIG. 4*b* is a schematic view of a sound-absorbing panel, a fixing member, an arm and an articulated joint between them according to another embodiment of the invention.
Figure 5:
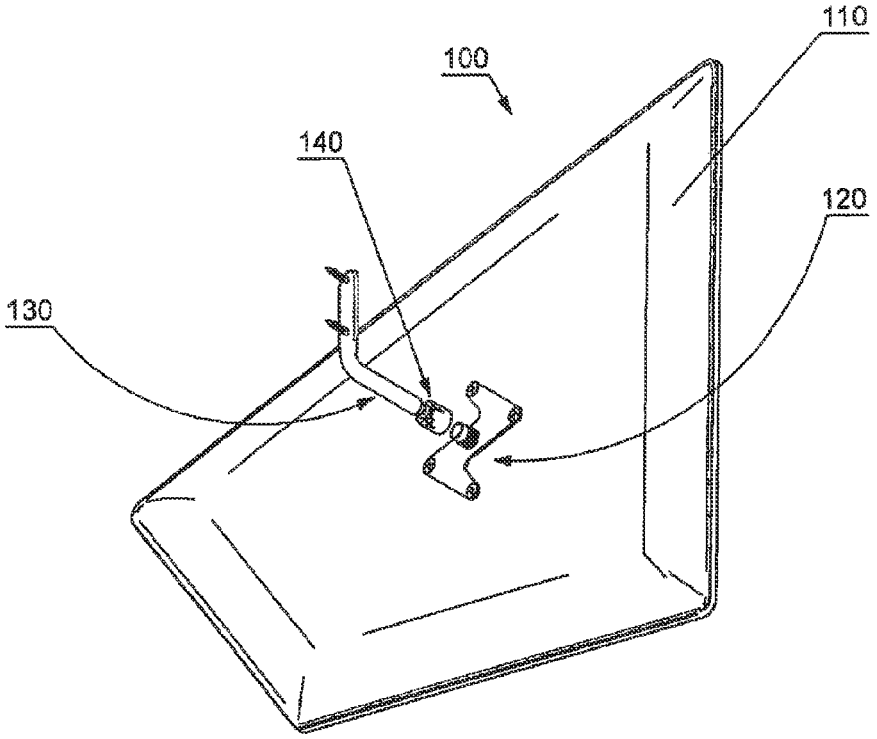
FIG. 5 is similar to FIG. 4*a* but shows the articulated joint disassembled such that the arm is separate from the panel.
Figure 6:
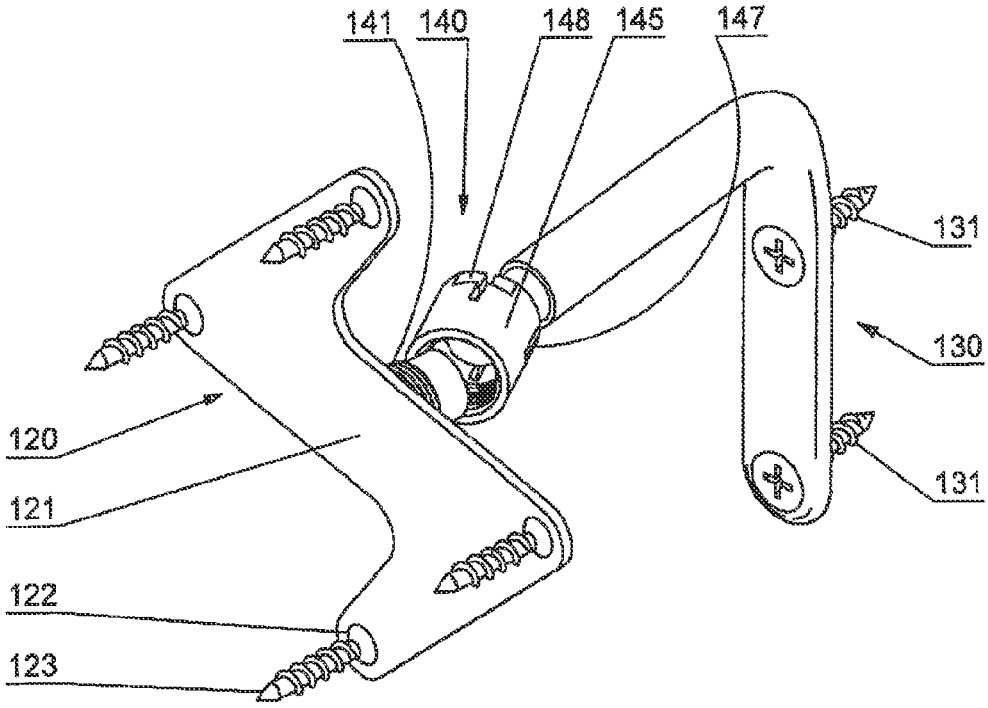
FIG. 6 shows an enlarged view of the articulated joint according to FIG. 4*a* disassembled, without the panel.
Figure 7:
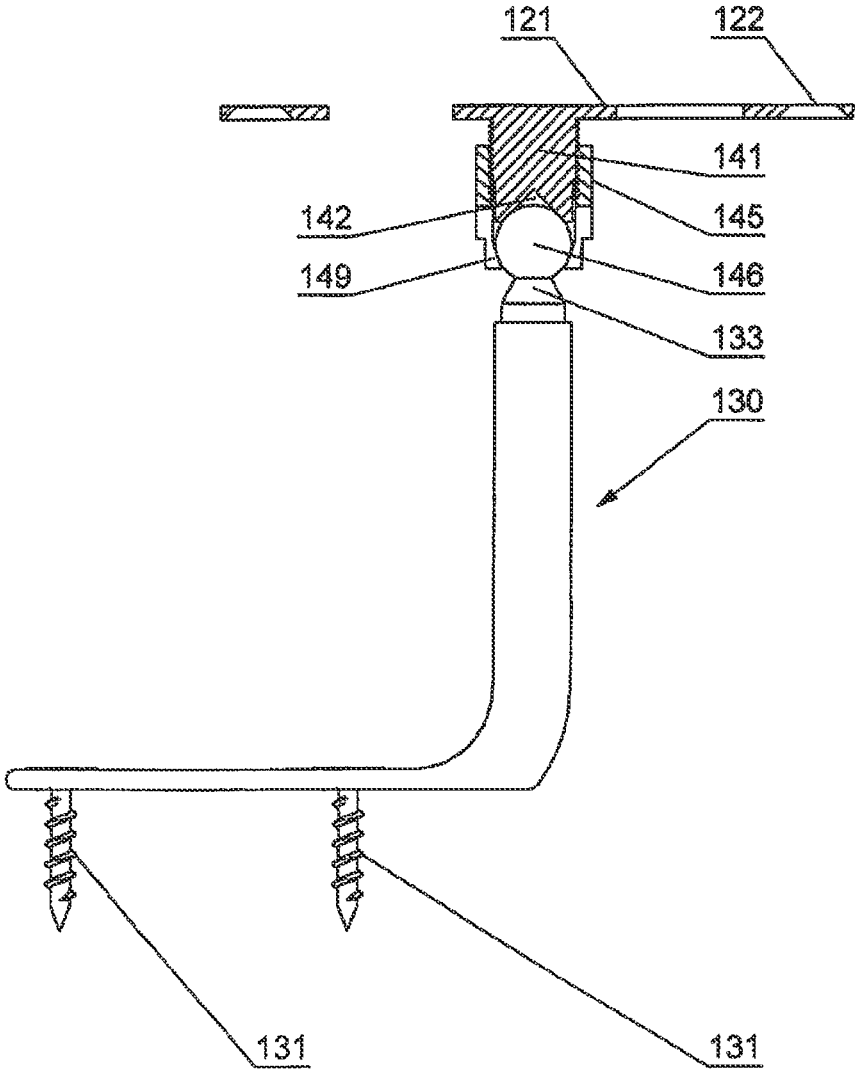
FIG. 7 is a partial cross-sectional view of the articulated joint according to FIG. 4*a* in the clamped configuration.

FIGS. 4*a*, 4*b* and 5 show a directable sound-proofing panel 100 according to the invention, comprising a sound-proofing panel 110, preferably with the characteristic features described above, a fixing member 120, an arm 130 and an articulated joint 140 between them.

The fixing member 120 may be in the form of a plate 121 with a surface which can be joined to one side of the sound-proofing panel. The plate 121 is preferably provided with holes so that it may be fixed by means of screws 123 to the sound-absorbing panel. In a preferred embodiment the plate 121 has a Z shape with two holes 122 in each section of the Z. As an alternative or in addition to fixing by means of screws 123, the plate 121 may be fixed using an adhesive, velcro or clip-on buttons. By way of a further alternative, the plate 121 may be fixed using magnetic means.

As shown in FIGS. 4*a*, 4*b*, 5, 6 and 7, an arm 130 is fixed to the fixing member 120 by means of an articulated joint 140. The articulated joint 140 is partly formed on the arm 130 and partly formed on the fixing member 120.

In the embodiment shown in FIGS. 4*a* and 5-7, the articulated joint 140 comprises a base 141 integral with the plate 121, a gripping clamp 145 and spherical head 146 integral with the arm 130. The base 141 comprises, at the top, a cavity with an inset surface 142 which has a conical or spherical shape complementing the spherical head 146 of the arm 130.

The outer surface of the base 141 is threaded so as to cooperate with an internal thread of the clamp 145 which has the function of gripping the spherical head 146 of the arm 130 on the plate 121 in a desired direction.

The clamp 145 is preferably a hollow cylindrical member with four slits 147 arranged diametrically opposite each other at 90° and extending to about halfway along its length. The presence of the four slits 147 provides the clamp with a certain degree of elasticity so that a varying clamping action may be provided. The retaining action is also made possible by a rim 149 (also slitted) which reduces the diameter of the opening in the clamp at the top end, namely at the end opposite to the threaded end.

Preferably, the outer surface of the clamp 145 is knurled so as to favor gripping and so that it may be screwed/unscrewed more easily in order to direct, lock in position or replace and reposition the panel, also manually and without the need for tools. Advantageously, in the proximity of the top end (i.e. the end with the slits 147) there are two parallel and opposite surfaces 148 which allow tightening of the clamp 145 using a tool such as a fixed spanner or pliers.

The clamp 145 exerts a gripping force directly on the ball 146, allowing adjustment thereof and acting as a friction member which allows handling of the panels to be adjusted until locking in the desired position is performed.

A panel, before the clamp 145 is fully tightened, may rotate through 360° and/or may be directed as required.

Preferably, the arm, the spherical head and the clamp are made of metallic material. Preferably, the spherical head has a chrome-plated surface and the clamp has a surface which is softer, for example nickel-plated.

FIG. 4*b* is a schematic representation of a second embodiment of an articulated joint 140 according to the invention. This articulated joint is realized for example by means of a flexible spiral tube which is substantially able to maintain the deformation imparted to it. This type of articulated joint in the form of a flexible tube is known per se and will not be described in more detail.

According to one embodiment, the arm 130 is an L-shaped member as shown in some of the figures. One side of the L is preferably shaped as a flat strip with fixing holes for screws 131, while the other side of the L is shaped with a cylindrical cross-section. The two sides are arranged substantially at 90° and between them a curved transition section from the flat strip to the cylindrical cross-section is formed.

As mentioned above, the side with a cylindrical cross-section terminates in a spherical head 146. Between the spherical head 146 and the side of the arm 130 with a circular cross-section there is preferably provided a neck 133 which is tapered towards the spherical head 146 and which allows a greater degree of directional adjustment of the arm 130 with respect to the plate-type fixing member and therefore a greater degree of directional adjustment of the panel 110.

Owing to the arm described above, a sound-absorbing panel may be fixed to any surface (for example a wall, a ceiling, a partition for rooms) or to another object, for example a support post, a guide or the like.

The arm 130 may also have a shape other than the L shape described and illustrated above, depending on the fixing method and depending on the configuration to be provided.

Figure 8:
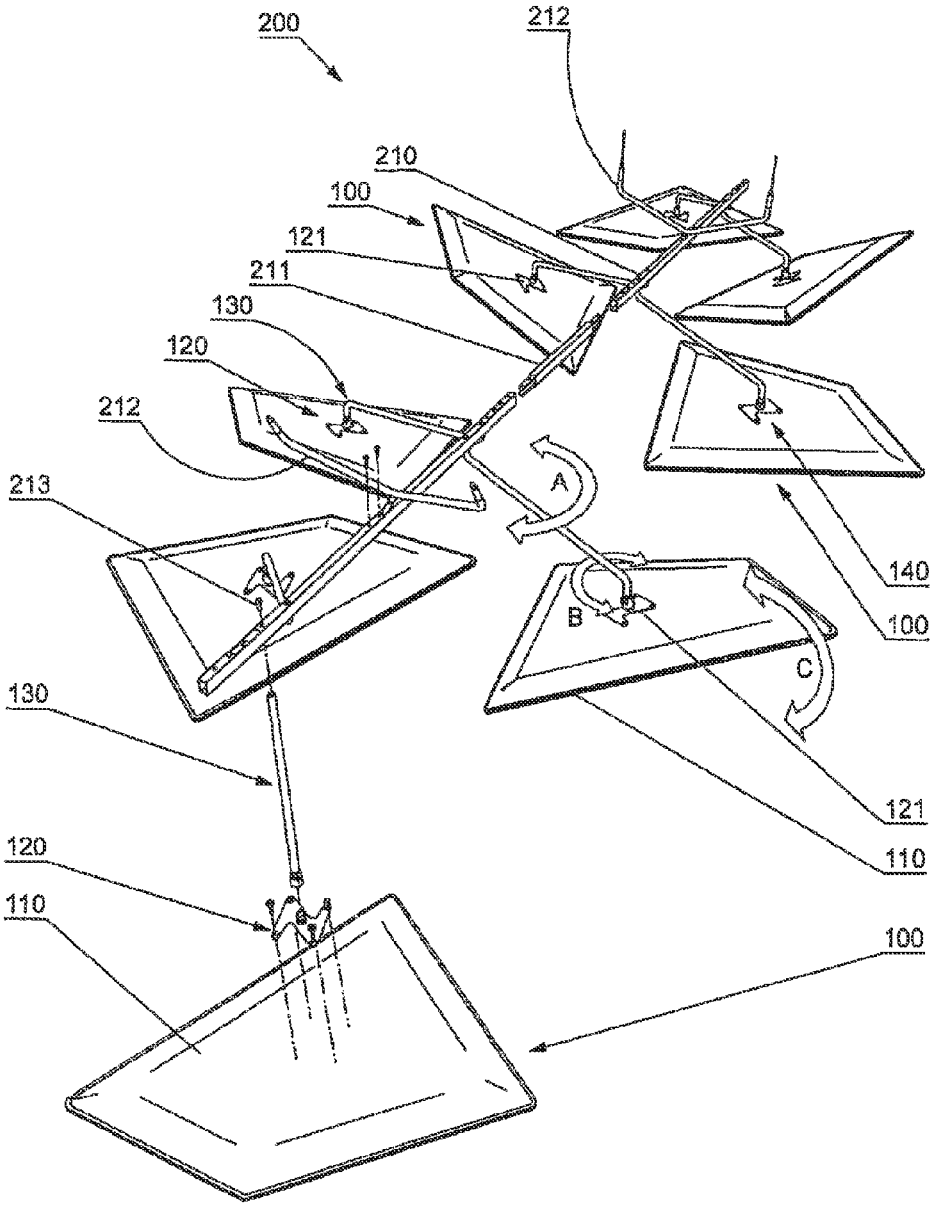
FIG. 8 shows an assembly of sound-absorbing panels according to an embodiment of the invention.

FIG. 8 shows an assembly 200 of directable sound-absorbing panels according to the invention. The assembly comprises a plurality of sound-absorbing panels 110 (eight sound-absorbing panels are shown in FIG. 8 by way of a non-limiting example), a corresponding plurality of fixing members 120, a corresponding plurality of arms 130 and a corresponding plurality of articulated joints 140 arranged between them so that the direction of the panel 110 may be adjusted. The assembly 200 also comprises, preferably, a fixing bar 210 to which a certain number of arms 130 may be fixed. In the embodiment according to FIG. 8, four arms 130 and therefore four corresponding directable sound-absorbing panels 100 may be fixed to each fixing bar 210. A connection piece 211 may be provided for connecting together two fixing bars.

In turn, the bars 210 may be fixed to a surface, for example to the ceiling of a room by means of a U-shaped bracket 212 (as shown in FIG. 8) or in some other way.

The arms 130 may be fixed to the bar in any manner, preferably in such a way as to allow the arm to be rotatable relative thereto. FIG. 8 shows schematically (as regards the panel in the foreground) how the arm 130 may be fixed to the bar 210 by means of a screw 213 which engages inside a through-hole in the bar 210 and engages with a thread formed at the end of the arm.

The arms 130 may have any shape. FIG. 8 shows, by way of a non-limiting example, arms 130 with a Z or S shape.

FIG. 8 shows schematically by means of double-headed arrows (A, B, C) some of the possibilities of adjusting the direction of the directable sound-absorbing panels according to the assembly of panels of the invention. The various panels 110 are directed differently depending on the requirements of the environment in which they are installed.

In one advantageous embodiment all the panels in the assembly have the same shape and the same size. The panels shown in the assembly illustrated in FIG. 8 have an irregular quadrilateral shape with three acute angles and an obtuse angle.

The single sound-absorbing panel and/or the assembly of panels according to the invention may be combined with lamps or other lighting or sound and music emission sources.

In compositions formed by various panels, the system allows panels to be replaced, removed and repositioned easily and quickly without having to use tools.

In compositions formed by differently colored panels, the system allows panels to be replaced, removed and repositioned, modifying the arrangement of the colors easily and quickly, without having to use tools.

Moreover, the free positioning allows the inclinations of the panels to be changed as required creating different effects and allowing the nature of the composition to be renewed occasionally, without replacing anything.

Moreover, the possibility of arranging and inclining a composition of panels with apparently random inclinations and directions and the space which is created between the panels improves the diffractive effect, improving the acoustic performance thereof. Owing to the fact that the direction of the panels is freely adjustable, it is also possible to use them as diffusers.

The directable support system is also suitable for use with sound-absorbing panels which have a traditional structure, for example being attached to the support frame or to a rigid bottom surface of the sound-absorbing panel.

The invention claimed is:

1. A directable sound-absorbing panel comprising:

a sound-absorbing panel, said panel further comprising a padding layer with heat-bonded synthetic fibers, wherein said padding layer has a first thickness and wherein, in at least one portion of said panel, said padding layer has a variable density, in a direction substantially transverse to the outer surface, said density being higher in an outer layer thereof and being lower in its inner layer;

a fixing member which can be fixed to said sound-absorbing panel;

an arm; and an articulated joint between said fixing member and said arm.

2. The directable sound-absorbing panel according to claim 1, wherein the fixing member comprises a plate having one side cooperating with a surface of the sound-absorbing panel.

3. The directable sound-absorbing panel according to claim 1, wherein the articulated joint is a ball joint.

4. The directable sound-absorbing panel according to claim 3, wherein the articulated joint comprises:

a base integral with the said fixing member;

a spherical head integral with the arm; and a gripping clamp for gripping said spherical head on said base.

5. The directable sound-absorbing panel according to claim 1, wherein the articulated joint comprises a flexible tube designed to maintain a deformation imparted to it.

6. The directable sound-absorbing panel according to claim 1, wherein the arm comprises a tubular section.

7. The directable sound-absorbing panel according to claim 1, wherein the arm has an L shape with a flattened section.

8. The directable sound-absorbing panel according to claim 1, wherein said fixing member is fixed to said sound-absorbing panel by means of screws which are directly screwed into said sound-absorbing panel.

9. The directable sound-absorbing panel according to claim 1, wherein the sound-absorbing panel further comprises:

a first layer of fabric facing a first side of said padding layer; and a second layer of fabric facing a second side of said padding layer.

10. The directable sound-absorbing panel according to claim 1, wherein said padding layer is shaped so as to have an edge with a second thickness which is smaller than the first thickness on at least a part of the perimeter of said panel.

11. The directable sound-absorbing panel according to claim 1, wherein said sound-absorbing panel has the shape, in plan view, of an irregular quadrilateral with a single obtuse angle.

12. The directable sound-absorbing panel according to claim 1, wherein the heat-bonded synthetic fibers comprise polyester fibers.

13. An assembly of directable sound-absorbing panels comprising:

a plurality of sound-absorbing panels, each of said panels further comprising a padding layer with heat-bonded synthetic fibers, wherein said padding layer has a first thickness and wherein, in at least one portion of said panel, said panel padding layer has a variable density, in a direction substantially transverse to the outer surface, said density being higher in an outer layer thereof and being lower in its inner layer;

a corresponding plurality of fixing members;

a corresponding plurality of arms;

a corresponding plurality of articulated joints between each arm and each fixing member; and a fixing bar to which at least a part of said plurality of arms is fixed.

14. The assembly of directable sound-absorbing panels according to claim 13, wherein each of the fixing members comprises a plate having one flat side cooperating with a surface of a sound-absorbing panel.

15. The assembly of directable sound-absorbing panels according to claim 13, wherein each of the articulated joints is a ball joint.

16. The assembly of directable sound-absorbing panels according to claim 15, wherein at least one of the articulated joints comprises:

a base integral with a respective fixing member;

a spherical head integral with the arm; and a gripping clamp for gripping said spherical head on said base.

17. The assembly of directable sound-absorbing panels according to claim 15, wherein at least one of the articulated joints comprises a flexible tube designed to maintain a deformation imparted to it.

18. The assembly of directable sound-absorbing panels according to claim 13, wherein each arm comprises a tubular section and is rotatable (A) with respect to said bar.

19. The assembly of directable sound-absorbing panels according to claim 13, wherein each panel has the shape, in plan view, of an irregular quadrilateral with a single obtuse angle.

20. The assembly of directable sound-absorbing panels according to claim 13, wherein the heat-bonded synthetic fibers comprise polyester fibers.

* * * * *